US005831210A

United States Patent [19]

Nugent

[11] Patent Number: 5,831,210

[45] Date of Patent: Nov. 3, 1998

[54] BALANCED AUDIO INTERCONNECT CABLE WITH HELICAL GEOMETRY

[76] Inventor: Steven Floyd Nugent, 3240 NW 132 Pl., Portland, Oreg. 97229

[21] Appl. No.: 604,185

[22] Filed: Feb. 21, 1996

[51] Int. Cl.[6] ..... H01B 11/02

[52] U.S. Cl. ..... 174/27; 174/36

[58] Field of Search ..... 174/32, 33, 34, 174/36, 27; 310/213; 336/187

[56] References Cited

U.S. PATENT DOCUMENTS

| | | | |
|---|---|---|---|
| 411,137 | 9/1889 | Campbell | 174/34 |
| 615,349 | 12/1898 | Field | 174/34 |
| 995,588 | 6/1911 | Cuntz | 174/36 |
| 3,205,296 | 9/1965 | Davis et al. | 174/34 |
| 4,146,854 | 3/1979 | Ishino et al. | 333/81 R X |
| 4,396,800 | 8/1983 | McDonnell et al. | 179/1 H X |
| 5,033,091 | 7/1991 | Bond | 381/94 X |
| 5,058,172 | 10/1991 | Ross et al. | 381/122 X |
| 5,064,966 | 11/1991 | Palmer | 174/32 |
| 5,095,296 | 3/1992 | Parker | 336/92 |
| 5,109,140 | 4/1992 | Nguyen | 174/36 |
| 5,266,744 | 11/1993 | Fitzmaurice | 174/103 X |
| 5,548,082 | 8/1996 | Palmer | 174/34 |

*Primary Examiner*—Bot L. Ledynh
*Assistant Examiner*—Chau N. Nguyen

[57] ABSTRACT

Two insulated signal conductors are wrapped in a double-helix fashion around a substantially straight third insulated ground conductor to form an interconnect. The first signal conductor is wrapped in a clockwise direction around the ground conductor. The second signal conductor is wrapped in a counter-clockwise direction around the ground conductor and first signal conductor, creating a spaced twisted-pair of the two signal conductors. The wrap frequency of the second conductor is lower than the wrap frequency of the first conductor. The difference in wrap frequencies of the first and second conductors is controlled such that the lengths of the first and second conductors are equal regardless of the length of the ground conductor. The wrap frequencies of the first and second signal conductors around the ground conductor are also chosen such that their intersections will be substantially orthogonal. The signal conductors can be composed of stranded wire in which the strands are straight as opposed to being twisted or braided with each other.

3 Claims, 6 Drawing Sheets

BALANCED AUDIO INTERCONNECT CABLE WITH HELICAL GEOMETRY

BACKGROUND OF THE INVENTION

1. Field of the Invention

The present invention relates to the field of audio electronics, and in particular to cables for the transmission of line-level analog audio signals using balanced signaling.

2. Description of the Related Art

High quality high-fidelity components used for music reproduction such as preamplifiers, amplifiers, digital-to-analog converters and tuners often employ analog signaling to convey the music signal from one component to the next.

In order to prevent degradation of analog signals during transmission from one component to another, balanced or differential signaling techniques are sometimes employed. Balanced signaling involves the transmission of two versions of the analog signal on each of two conductors. The first conductor carries a positive or non-inverted version of the signal and the second conductor carries an identical but negative or inverted version of the signal. This configuration reduces the susceptibility to externally induced noise. Noise reduction occurs because the destination component, by sensing only the difference between the signals on the two conductors, filters out any noise that is common to both conductors. This is known as common-mode noise rejection. A third conductor is generally used to connect the grounds of the two components to insure that their ground potentials are the same. Ideally, there is no current flow on the ground conductor as the balanced signal conductor pair act as return current paths for each other. This further reduces noise susceptibility by insuring that the ground conductor impedance does not interact with the signal currents.

Signal degradation can occur in balanced interconnects due to the interaction of the signal conductors with the driving and receiving components. A number of measurable physical parameters quantify this interaction including: impedance, group delay, phase delay, bandwidth and susceptibility. It is desirable to optimize these parameters in order to minimize degradation of the signal as it is conveyed from one component to the next.

Since the signal conductors both transfer the signal from the source component to the destination component, it is critical that they are the same length, have identical physical characteristics and complementary geometries with each other. Ideally, upon arrival at the destination component, the two signal waveforms should be identical except for being inverted from each other. If the two conductors are geometrically located and sufficiently close, the fields created by each will effectively cancel and no radiated emissions will result, particularly at high frequency. The impedance of an audio interconnect comprises a combination of resistance, inductance and capacitance and is considered "lumped" as opposed to distributed because at audio frequencies the electrical delay of the transmission-line is much smaller than the transition-time for the fastest transient music waveform. Because the impedance appears to the source driver as a lumped element, the inductance, resistance and capacitance in the interconnect is a function of the length of the interconnect. Most metallic conductors used in audio interconnects have negligible resistance compared to a typical driver output impedance. Therefore, in most cases the resistance of the interconnect does not significantly contribute to the degradation of the signal. Because the typical driver in a high fidelity component has a non-zero output impedance and the receiver has a non-infinite input impedance, any significant interconnect inductance and capacitance combine with these impedances to form a network which acts as a low-pass filter. This filter effects the audio signal primarily by attenuating the higher frequencies. This is further aggravated by the fact that balanced circuits often have a resistive termination of between 600 and 1000 ohms at the signal destination, particularly in professional audio equipment. This terminating resistance tends to increase the R-C time-constant of the interconnect causing the high frequencies to roll-off.

Due to the aforementioned effects, eliminating signal degradation in an interconnect primarily involves minimization of the inductance and capacitance.

In order to minimize the inductance, large gauge conductors are typically used in interconnects, however there is a practical upper limit because of "skin effects". Skin effects are present due to the wide band of frequencies that are present in most high-fidelity music material. The currents associated with the low frequencies tend to travel deeper within the cross-section of the conductor than the high frequencies which tend to travel more on the outer surface skin of the conductor. This is known as skin-effect. Skin effect is a function of the conductor material and geometry. The music signal can become distorted or smeared due to changing phase as the frequency changes. To minimize this phase distortion, the currents of all frequencies of the audio spectrum can be forced to flow through the same media and have the same uniform dielectric around them. One method that has been used to accomplish this is to limit the gauge of the conductors so that the skin depth of the currents at the highest frequencies completely penetrate the conductors. Alternately, larger diameter hollow conductors have been used in order to confine the current flow at all frequencies mechanically.

Another approach that has been used to reduce inductance is to space the signal conductors away from each other. This typically causes the cable diameter to become large and the cable mechanically inflexible. If there is no overall shield, this type of interconnect is more susceptible to noise than interconnects with closely spaced conductors.

The capacitance between the conductors, however is more difficult to minimize, since it is a function of the cable geometry, length, dielectric insulators and conductor shape. One method commonly used to decrease the capacitance is to use dielectric materials such as Teflon™ TFE and expanded Teflon™ as insulators. These are low dielectric constant materials which tend to lower the capacitance and allow the conductors to be spaced more closely. Other methods for reducing capacitance include geometries that separate the conductors with air-filled materials and air-gaps.

Various techniques have been devised that attempt to minimize interconnect capacitance at the same time providing some level of immunity from external noise sources. FIG. 1 illustrates three prior art interconnect geometries that are used in high-performance audio systems.

FIG. 1*a* is a typical balanced interconnect geometry, a twisted-pair 101 with overall shield 102. The capacitance between the signal pair in this case is typically minimized by using Teflon™ insulation and air-filled materials around the twisted-pair to enlarge the overall shield diameter. The diameter is generally limited by the requirement for the cable to be flexible for routing and for connection considerations. The signal conductors are generally stranded wire, the strands being twisted together to approximate a cylindrical shape. To accomplish this with round wire, either 7 or 19 strands are typically twisted together. Twisted stands are used in order to facilitate manufacture and cladding with insulation. Twisted strand configurations have the disadvantage that diode and resistance discontinuities can result where the strands contact each other, particularly in copper conductors which can have copper oxidation at these boundaries. These discontinuities can cause degradation in the signal by creating non-linearity in the interconnect transfer function. Silver-plated copper wire strands are sometimes used to eliminate the copper-oxide diode effect, however this has the disadvantage of creating a non-uniform transmission media. The difference in signal velocity, permittivity and permeability of silver and copper can cause non-linearity in the phase response of the interconnect. Pure silver conductors eliminate the diode effect, but silver oxide can create resistive discontinuities at the strand boundaries. The twisted-pair with overall shield has the disadvantage that there is significant capacitive coupling between the signal conductors of the twisted signal pair because the insulated conductors are in continuous contact with each other. The signal pairs also each couple to the overall shield. Some existing solutions have tried to minimize the shield coupling by providing only a partial shield. In general, these types of interconnects rely on filler materials to provide mechanical support for the twisted-pair to keep it suspended in the center of the shield. The fillers generally consist of various loose or woven fibers or hollow tubing. The disadvantage of this technique is that it is difficult to achieve high percentages of air content in these fillers, the result of which is high interconnect capacitance.

Other interconnect approaches orient the two signal conductors so that they are parallel. FIG. 1*b* is a double helix 103 which has been wrapped around a larger-diameter core 104 to further reduce line-to-line capacitance. This geometry has the disadvantage that some of the well known noise-rejection properties of the twisted-pair are diminished due to the relatively large space between the signal conductors. Since the signal conductors are parallel to each other, any large adjacent surface area between them will tend to increase capacitance. To minimize this effect, one existing interconnect utilizes flat ribbon shaped solid conductors and orients them such that the narrow edges of the conductor ribbons were adjacent to each other. Because of the large diameter created between the signal conductors, parallel geometries are generally augmented by an overall shield 105 to improve noise-rejection. The overall shield has the disadvantage of adding to the capacitance of the interconnect by creating capacitive coupling between the two signal conductors and the shield. This coupling occurs because the driver impedance, which is generally on the order of a few ohms, appears between the shield (which is grounded at the source component) and the source driver signal outputs.

Geometries such as the simple braid of FIG. 1*c* have been used to reduce the capacitance between the conductors by forcing air-gaps between them. Air has the lowest dielectric constant, therefore it will reduce the capacitance more than other dielectric materials. One disadvantage of this braid is that no combination of two of the three signal conductors forms a twisted-pair geometry. The consequence of this is asymmetry in the geometry of the two signal conductors which leads to diminished noise-rejection properties. The absence of an overall shield also tends to increase noise susceptibility. Twisted-pairs have also historically been twisted around soft-iron cores in order to increase the inductance in order to balance the capacitance in order to achieve extended and more linear frequency response for long telephone land-lines. These geometries are twisted-pairs, but the outer conductor becomes much longer than the inner conductor over the length of the cable, making this type of cable unsuitable for balanced signaling.

Each of the aforementioned approaches provide a means for conveying audio signals between components, but are limited in their ability to achieve both low capacitance, physical flexibility and good noise rejection, while maintaining equal lengths and complementary geometries that are optimum for balanced signaling.

SUMMARY OF THE INVENTION

The present invention finds application in the field of high-fidelity audio, and particularly to line-level analog interconnects between audio components.

It is a general object of the present invention to provide an improved means for conveying line-level signals between audio components. More specifically, it is an object of the present invention to provide a transmission media for audio signals that causes minimal degradation to the audio signal, at the same time providing mechanical flexibility.

Briefly, the present invention is a balanced interconnect for conveyance of a single channel of audio signal that includes an insulated ground conductor and two insulated signal conductors, the two signal conductors being wrapped in a helical fashion in opposite directions along the length of the ground conductor. Both signal conductors are the same length. Each signal conductor includes an outer insulating flexible tubing. The ground conductor is an insulated wire that has a thicker or additional concentric outer insulating tubing. The conductors are terminated at both ends of the cable into 3-contact connectors.

In accordance with one important aspect of the invention, as an inner signal conductor is wrapped in a clockwise direction and an outer signal conductor in a counter-clockwise direction around the ground conductor, the frequency at which the outer signal conductor wraps (wrap frequency) is lower than the inner signal conductor This causes the conductors to have the same physical length, independent of the overall able length.

In accordance with another important aspect of the invention, each of the two signal conductors passes through a separate hole in a common ferrite slug in order to attenuate both differential and common-mode high frequency noise.

In accordance with still another important aspect of the invention, the signal conductors are composed of two or more silver or copper stranded wires such that the strands are oriented in a parallel straight line as opposed to being twisted or braided.

The geometry of the conductor wrap creates a twisted pair, maximizes the distance between the two signal conductors and eliminates parallelism. At points where the signal conductors are in close proximity, they are orthogonal to each other. These physical features serve to minimize the capacitance, provide symmetrical signal paths and provide good noise rejection without sacrificing mechanical flexibility.

Other objects, advantages and novel features of the present invention will become more apparent from the following detailed description of a preferred embodiment in conjunction with the accompanying drawings.

DETAILED DESCRIPTION OF THE INVENTION

Figure 2:
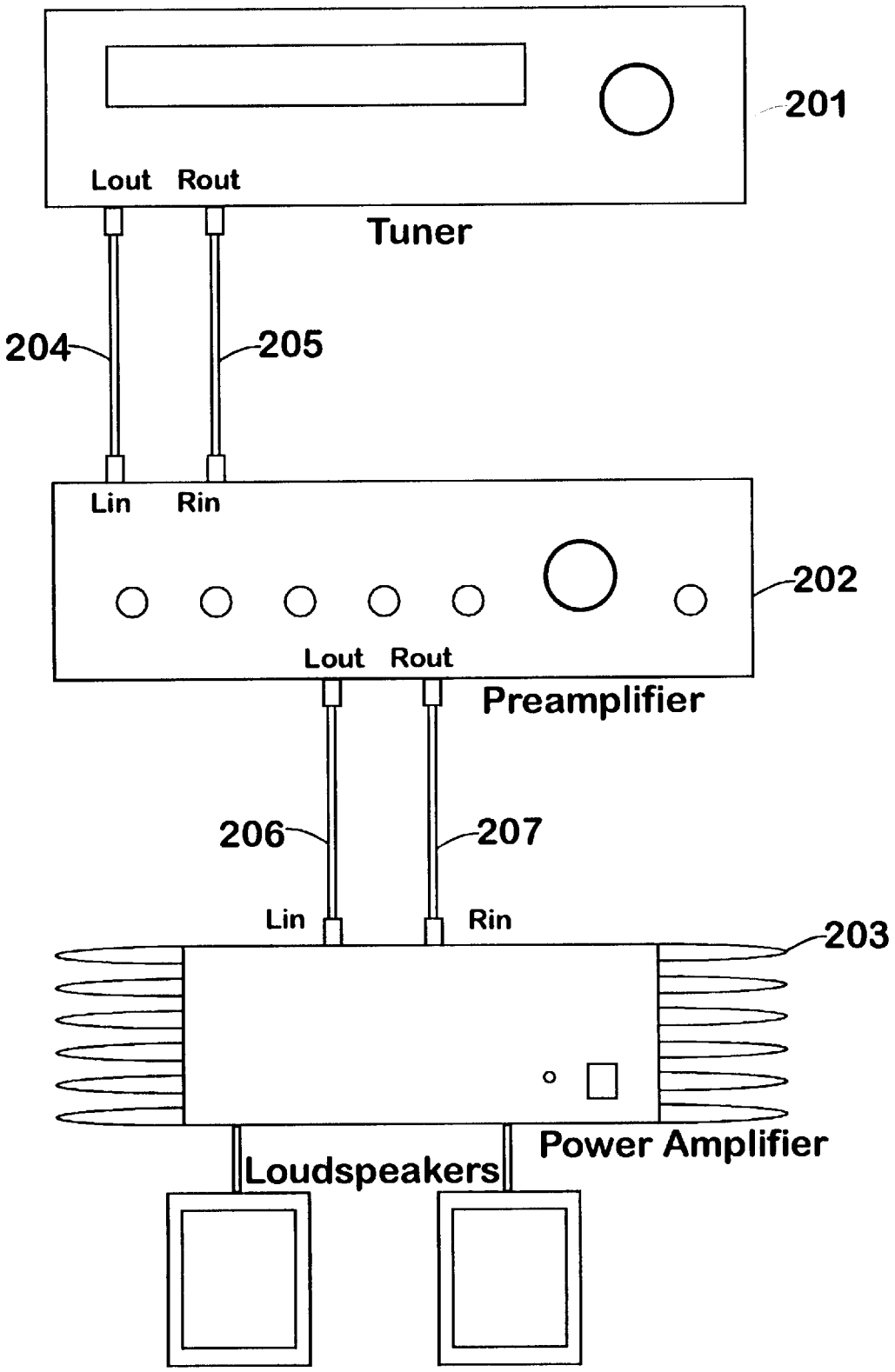
FIG. 2 is a block diagram illustrating an application of the present invention.

The present invention is a balanced audio interconnect for conveying audio signals between components of an audio system. FIG. 2 illustrates a typical application of the balanced interconnect. Three components in a typical audio system are shown, a tuner 201, a preamplifier 202 and a power amplifier 203. Interconnect cables that convey left and right channel line-level audio signals are connected between the tuner and preamplifier 204,205 and between the preamplifier and power amplifier 206,207. These interconnects typically range in length from 0.5 meters to about 10 meters. Balanced interconnects are generally terminated with XLR connectors at both ends.

The preferred embodiment of the present invention is illustrated using the combination of FIG. 3 and FIG. 4. FIG. 3 illustrates the construction of the conductors and the electrical schematic. FIG. 4 illustrates the way in which the conductors are geometrically arranged to form the interconnect.

Figure 3A:
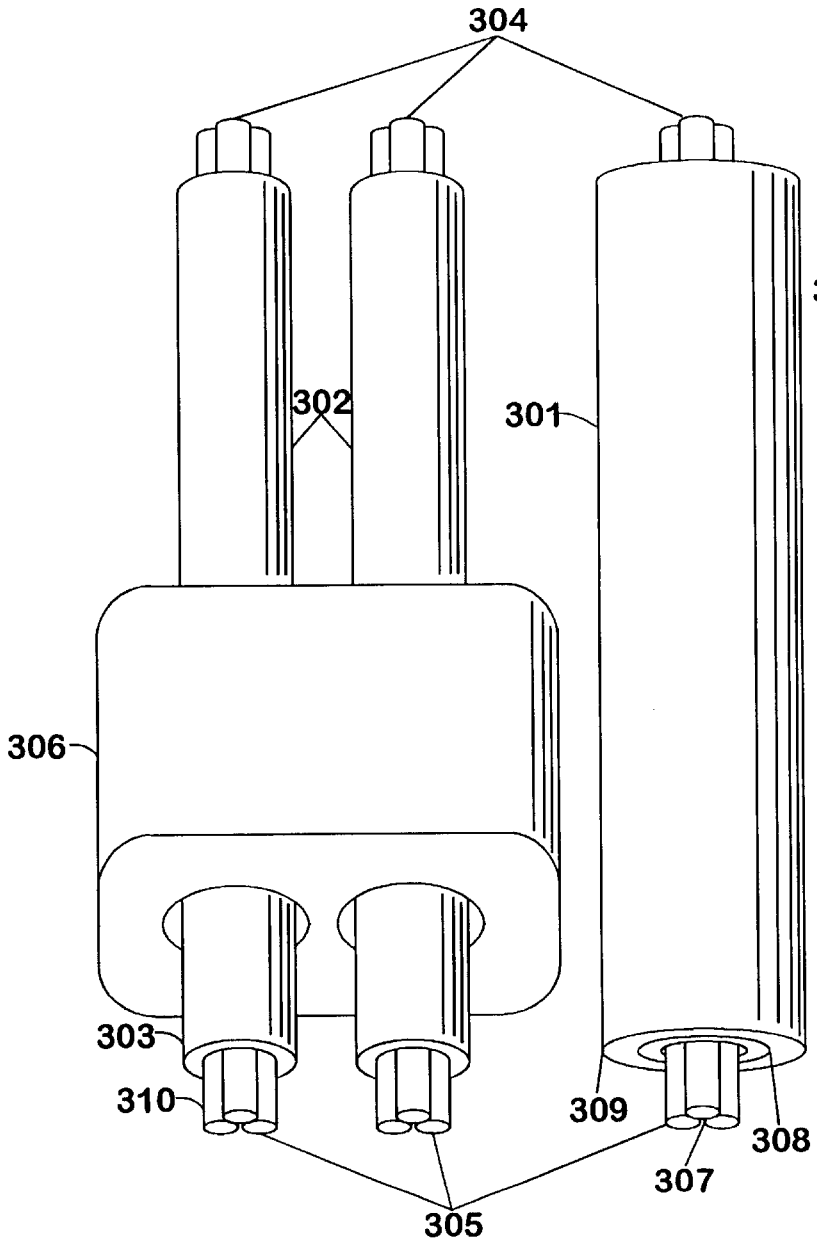
FIG. 3 illustrates the conductor structure and equivalent circuit diagram for the preferred embodiment of the present invention.

Referring to FIG. 3*a*, the interconnect is composed of three insulated conductors of which one is a ground 301 and the other two 302 are designated to carry signals. In FIG. 3 the conductors are laid flat for purposes of clarity. The interconnect has a source end 304 and a destination end 305. Located on the signal conductors is a ferrite core 306 that has two holes, one for each signal conductor. The ground conductor is composed of one or more strands 307 of copper or fine silver, insulated with low dielectric constant insulating material 308 and covered with a second concentric layer 309 in the form of flexible tubing of similar material which serves to increase the thickness of the insulating covering. The signal-carrying conductors are composed of three copper or fine silver wires 310 which are insulated with low dielectric constant insulating material. These wires are not twisted with each other, but run linearly through the insulating tubing. This arrangement helps to keep the signal current flow contained in each strand by minimizing the transitions from strand to strand within the strand bundle.

Figure 3B:
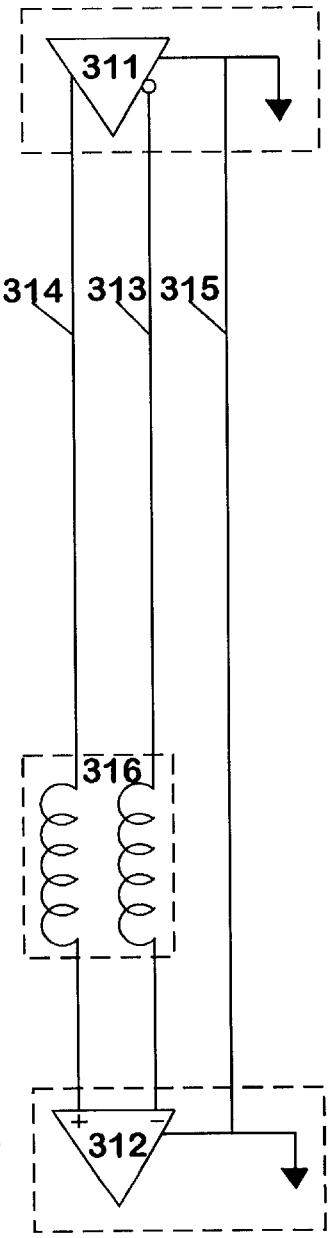
Figure 4A:
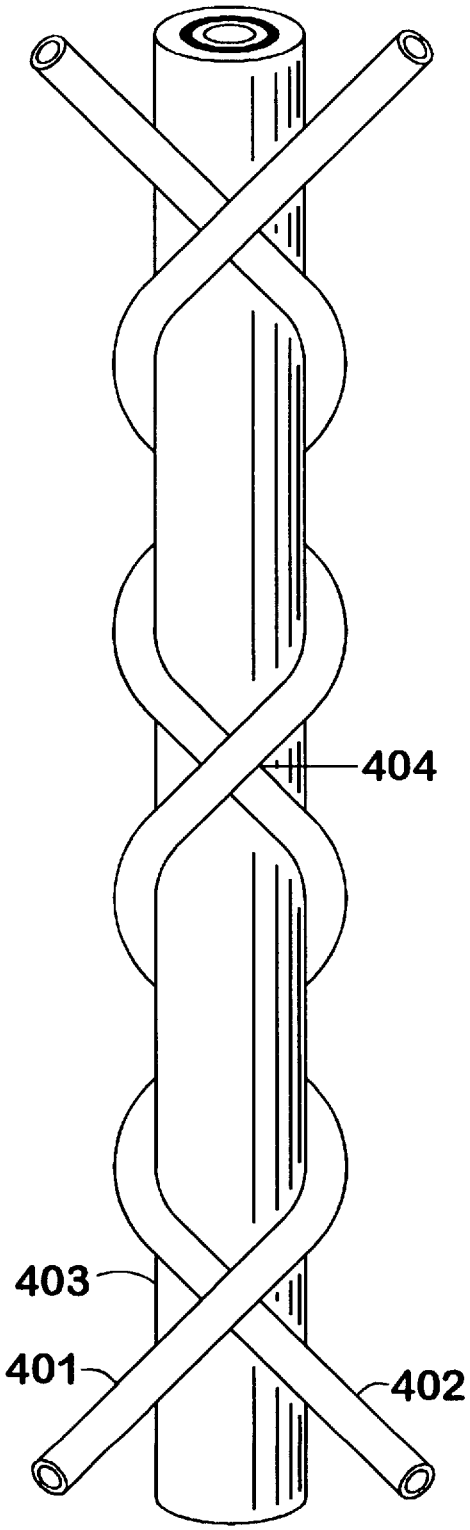
FIG. 4 illustrates the geometry of the present invention.
Figure 4B:
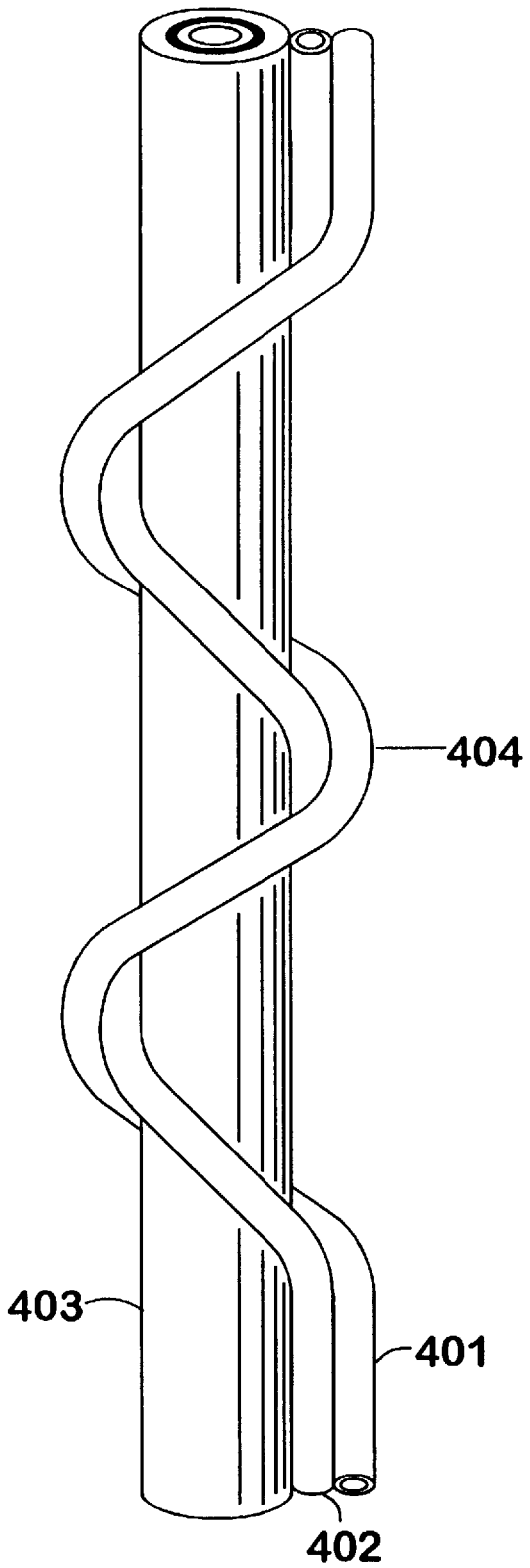

Referring to FIG. 3*b*, the schematic circuit representation of the interconnect is shown with the driver 311 and receiver 312 circuits that are integral to the components to be interconnected. The interconnect conveys an inverted 313 and a non-inverted 314 version of an audio signal from the driver 311 to the receiver 312. The ferrite core 306 is represented by two inductors 316. The ground conductor 315 causes the driver 311 and the receiver 312 components to be at the same voltage potential.

FIG. 4 illustrates the geometry of the interconnect. FIG. 4*a* is a front view and FIG. 4*b* is a side view. The two signal carrying conductors 401 and 402 are wrapped in a helical fashion, one in a clockwise direction and the other in a counter-clockwise direction around the ground conductor 403, the wrap spanning the length of the interconnect cable. Signal conductor 401 always remains on the outside of signal conductor 402 as they wrap. The outer conductor 401 wraps in the counter-clockwise direction and the inner conductor 402 wraps in the clockwise direction. As the helical wrap progresses along the length of the ground conductor, signal conductor 402 wraps at a higher frequency than signal conductor 401.

As a result of this difference in wrap frequency, the sequential crossings, 404, 405 and 406 of signal conductors 401 and 402 are visible precessing in a clockwise direction. The difference in wrap frequencies causes the lengths of signal conductor 401 and 402 to be identical regardless of the interconnect overall length. The difference in wrap frequency compensates for the fact that the outer conductor is forced to wrap around a slightly larger diameter than the inner conductor, since the outer conductor must wrap around the inner conductor in addition to the ground conductor. Precise matching of the lengths of the two conductors 401 and 402 is necessary in order to avoid differences in group delay and differences in forward and return currents that would cause distortion at the receive. The geometry of the wrap keeps the two signal conductors separated and non-parallel which reduces the capacitive coupling between them. The only places where the conductors are in close proximity to each other are at the crossings 404, 405 and 406 where they are orthogonal to each other. This also tends to minimize the capacitive coupling. Since there is no overall shield, the percentage of air in the dielectric surrounding the signal conductors is high, causing the capacitance per unit length to be low.

Figure 6A:
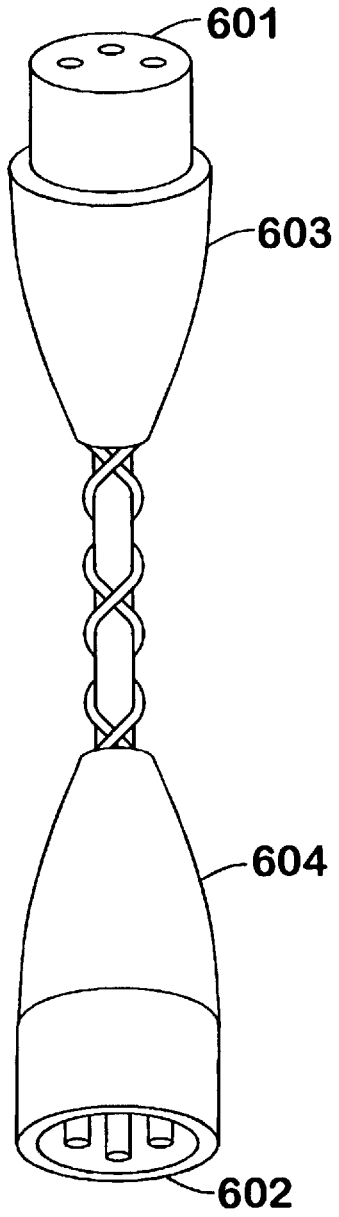
FIG. 6 illustrates complete assemblies of the preferred and alternate embodiments of the present invention.

The ends of the interconnect are generally terminated with XLR or other balanced 3-contact connectors. FIG. 6*a* illustrates a complete balanced interconnect assembly with female XLR 601 and male XLR 602 connectors terminating the interconnect. The back-shells 603,604 are preferably composed of non-metallic materials. Since the interconnect has no overall shield, the need for shielding at the terminations is optional. This has the advantage of further reducing the interconnect capacitance.

Figure 5A:
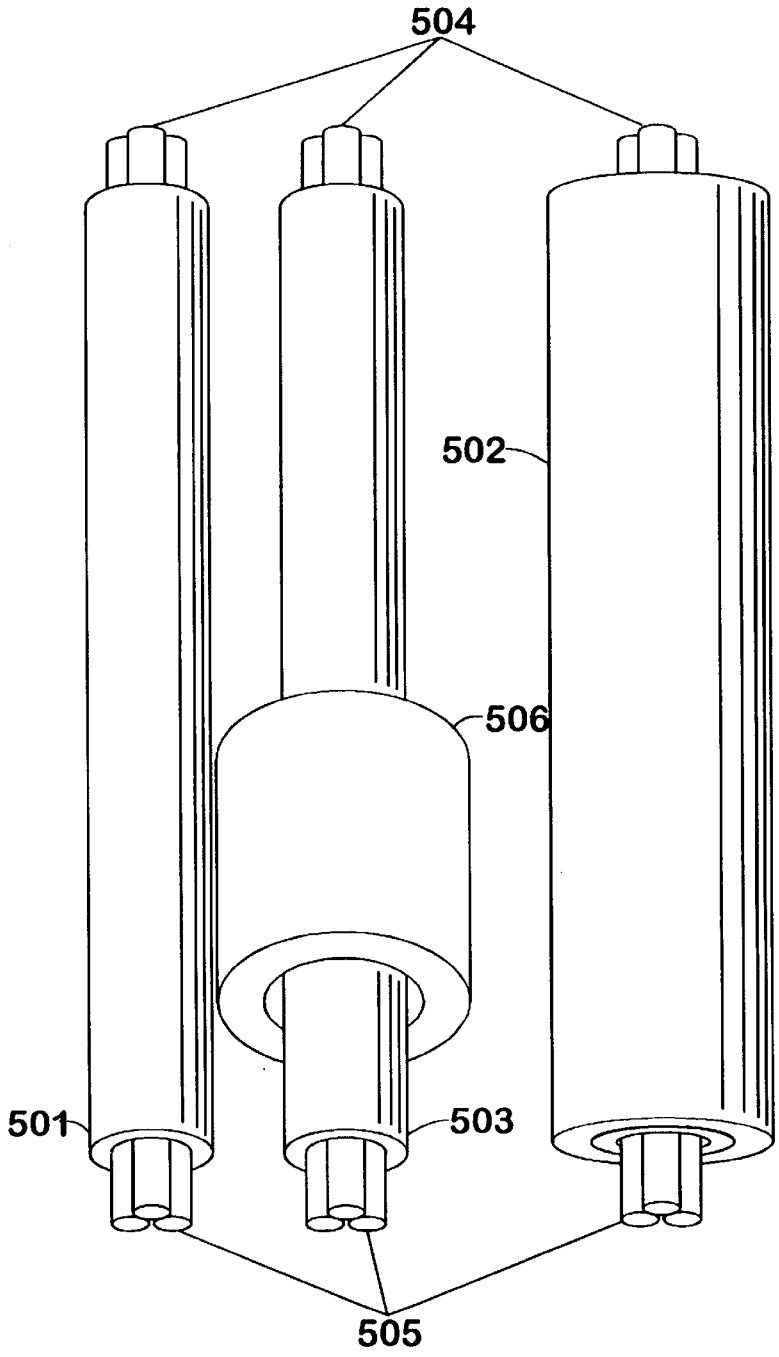
FIG. 5 illustrates an alternate embodiment of the present invention with the corresponding equivalent circuit which allows application as an unbalanced interconnect.

The alternate embodiment in FIG. 5 illustrates another application of the interconnect geometry of FIG. 4. FIG. 5 is an unbalanced or single-ended configuration. The application of the unbalanced interconnect is substantially the same as that shown in FIG. 2, the primary difference being that there is no active common-mode noise rejection in the circuit. By grounding one or two of the three conductors at the driving component and by grounding at the receiving component at least one of those grounded at the driving component, unbalanced operation is possible. In FIG. 5 the conductors are laid flat for purposes of clarity. FIG. 5*a* illustrates an unbalanced interconnect composed of three insulated conductors of which two are grounded 501,502 and the other 503 is designated to carry signals. The physical construction of the conductors is similar to those in FIG. 3. The interconnect has a source end 504 and a destination end 505. Located near the destination end are one or more ferrite beads 506 threaded onto the signal conductor 503 that act to increase the inductance locally to limit the bandwidth of the interconnect and act as a low-pass filter that attenuates frequencies much higher than the audio spectrum.

Figure 5B:
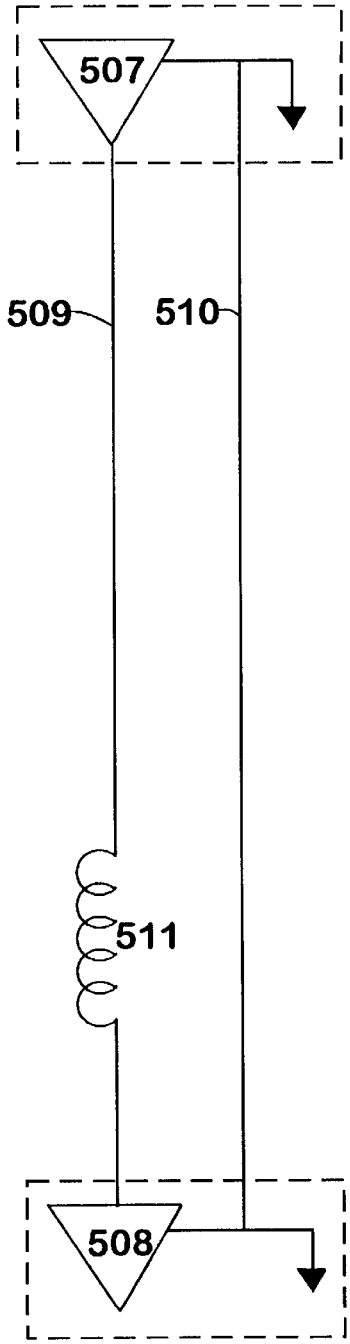

FIG. 5*b* illustrates the schematic circuit representation of the unbalanced configuration of the interconnect. The driver 507 has one output signal and the receiver 508 one input signal. The signal is carried from driver 507 to receiver 508 on a signal conductor 509. The current return path for the signal conductor 509 is the ground conductor 510. Since there are physically two ground conductors 501 and 502 in the interconnect, these are both represented by 510 in the circuit diagram. The ground conductors 501 and 502 will share the signal return current. The ferrite bead is represented by the inductor 511.

The capacitance of the unbalanced interconnect of FIG. 5 is higher than the balanced configuration of FIG. 3 because there are two ground conductors capacitively coupling to the signal. The geometry illustrated in FIG. 4 is also used for the unbalanced configuration. Conductor 402 is used as a signal conductor and conductors 401 and 403 are grounded. Conductor 403 is grounded at both the source and destination terminations, but conductor 401 may be grounded at both ends or only at one end. The geometry of FIG. 4 provides a partial overall shield for the unbalanced signal conductor. This provides an effective method of external noise rejection. At the same time, the ground conductors both form twisted pairs with the signal conductor. This twisted-pair geometry also aids in rejecting common-mode noise.

Figure 6B:
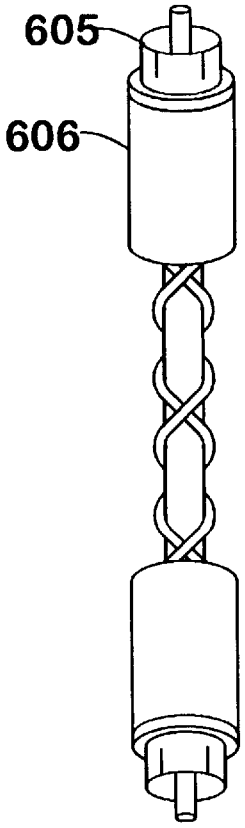
Figure 4A:
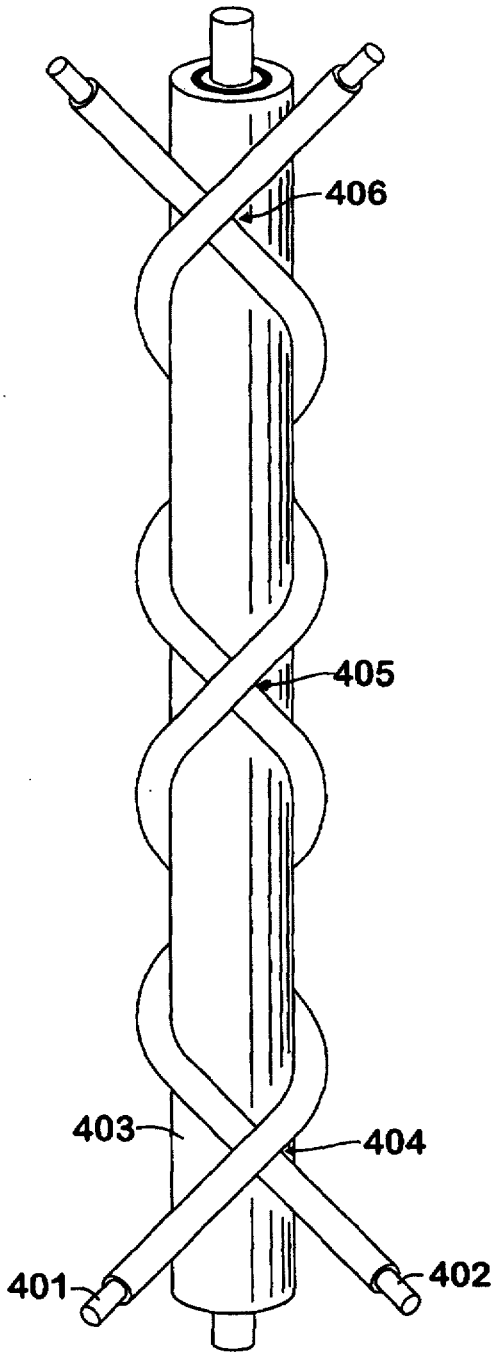
Figure 4B:
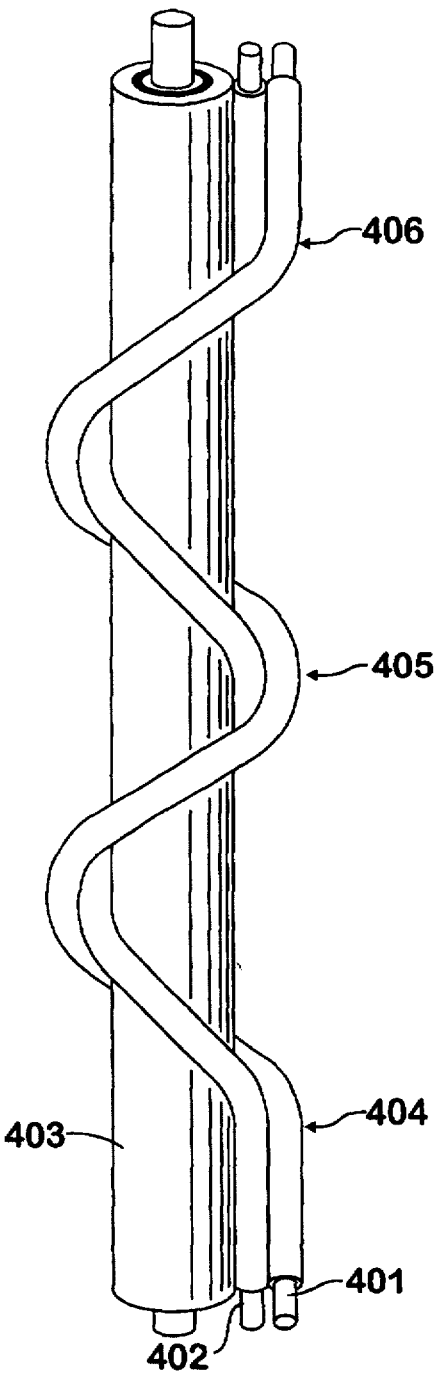

The ends of the unbalanced interconnect are generally terminated with RCA or other unbalanced 2-contact connectors. FIG. 6*b* illustrates a complete unbalanced interconnect assembly with RCA connectors 605 terminating both ends of the interconnect. The back-shells 606 are preferably composed of non-metallic materials. Since the interconnect has no overall shield, the need for shielding at the terminations is optional. This has the advantage of further reducing the interconnect capacitance.

The aforedescribed interconnect geometry provides an improved method to convey signals between audio components. The interconnect provides: improved noise rejection properties without utilizing an overall shield, improved phase linearity compared to solid or twisted stranded conductors, improved lower capacitance and improved mechanical flexibility.

What is claimed is:

1. An interconnect for conveying at least one channel of signal from a first component to a second component comprising:

a first signal conductor, a second signal conductor and a ground conductor, wherein said ground conductor is substantially straight, said first signal conductor is wrapped around said ground conductor in a clockwise direction and said second signal conductor is wrapped around said ground conductor and said first signal conductor in a counter-clockwise direction at a lower wrap frequency than said first conductor, causing the length of said first signal conductor and the length of said second signal conductor to be equal.

2. The interconnect as recited in claim 1, wherein each of said first and second signal conductors comprise a group of two or more metal strands, each of said metal strands being substantially straight and not twisted or woven with said group.

3. The interconnect as recited in claim 1, wherein said metal strands are composed of silver.

* * * * *

UNITED STATES PATENT AND TRADEMARK OFFICE

CERTIFICATE OF CORRECTION

PATENT NO. : 5,831,210
DATED : November 3, 1998
INVENTOR(S) : Steven F. Nugent

It is certified that error appears in the above-identified patent and that said Letters Patent is hereby corrected as shown below:

The title page should be deleted and substitute therefore the attached title page.

In the Drawing Figures 1a, 1b, 1c, 4a and 4b should be deleted and replaced with Figures 1a, 1b, 1c, 4a and 4b shown on the attaches pages.

Column 4,
Line 3, change "able" to -- cable --

Column 6,
Line 19, change "receive" to -- receiver --

Signed and Sealed this

Eleventh Day of December, 2001

*Attest:*

Nicholas P. Godici

*Attesting Officer*

NICHOLAS P. GODICI
*Acting Director of the United States Patent and Trademark Office*

United States Patent [19]

Nugent

[11] Patent Number: 5,831,210

[45] Date of Patent: Nov. 3, 1998

[54] BALANCED AUDIO INTERCONNECT CABLE WITH HELICAL GEOMETRY

[76] Inventor: Steven Floyd Nugent, 3240 NW 132 Pl., Portland, Oreg. 97229

[21] Appl. No.: 604,185

[22] Filed: Feb. 21, 1996

[51] Int. Cl.[6] ..... H01B 11/02

[52] U.S. Cl. ..... 174/27; 174/36

[58] Field of Search ..... 174/32, 33, 34, 174/36, 27; 310/213; 336/187

[56] References Cited

U.S. PATENT DOCUMENTS

| | | | |
|---|---|---|---|
| 411,137 | 9/1889 | Campbell | 174/34 |
| 615,349 | 12/1898 | Field | 174/34 |
| 995,588 | 6/1911 | Cuntz | 174/36 |
| 3,205,296 | 9/1965 | Davis et al. | 174/34 |
| 4,146,854 | 3/1979 | Ishino et al. | 333/81 R X |
| 4,396,800 | 8/1983 | McDonnell et al. | 179/1 H X |
| 5,033,091 | 7/1991 | Bond | 381/94 X |
| 5,058,172 | 10/1991 | Ross et al. | 381/122 X |
| 5,064,966 | 11/1991 | Palmer | 174/32 |
| 5,095,296 | 3/1992 | Parker | 336/92 |
| 5,109,140 | 4/1992 | Nguyen | 174/36 |
| 5,266,744 | 11/1993 | Fitzmaurice | 174/103 X |
| 5,548,082 | 8/1996 | Palmer | 174/34 |

*Primary Examiner*—Bot L. Ledynh
*Assistant Examiner*—Chau N. Nguyen

[57] ABSTRACT

Two insulated signal conductors are wrapped in a double-helix fashion around a substantially straight third insulated ground conductor to form an interconnect. The first signal conductor is wrapped in a clockwise direction around the ground conductor. The second signal conductor is wrapped in a counter-clockwise direction around the ground conductor and first signal conductor, creating a spaced twisted-pair of the two signal conductors. The wrap frequency of the second conductor is lower than the wrap frequency of the first conductor. The difference in wrap frequencies of the first and second conductors is controlled such that the lengths of the first and second conductors are equal regardless of the length of the ground conductor. The wrap frequencies of the first and second signal conductors around the ground conductor are also chosen such that their intersections will be substantially orthogonal. The signal conductors can be composed of stranded wire in which the strands are straight as opposed to being twisted or braided with each other.

3 Claims, 6 Drawing Sheets

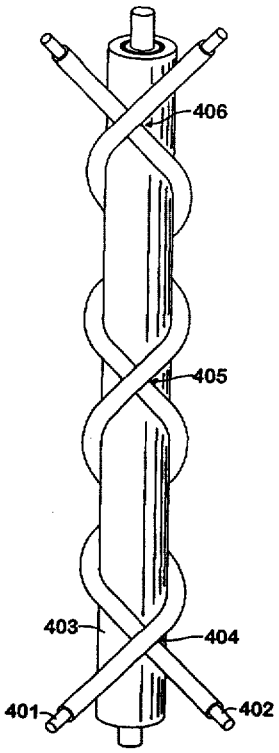

Figures 1A, 1B, 1C:
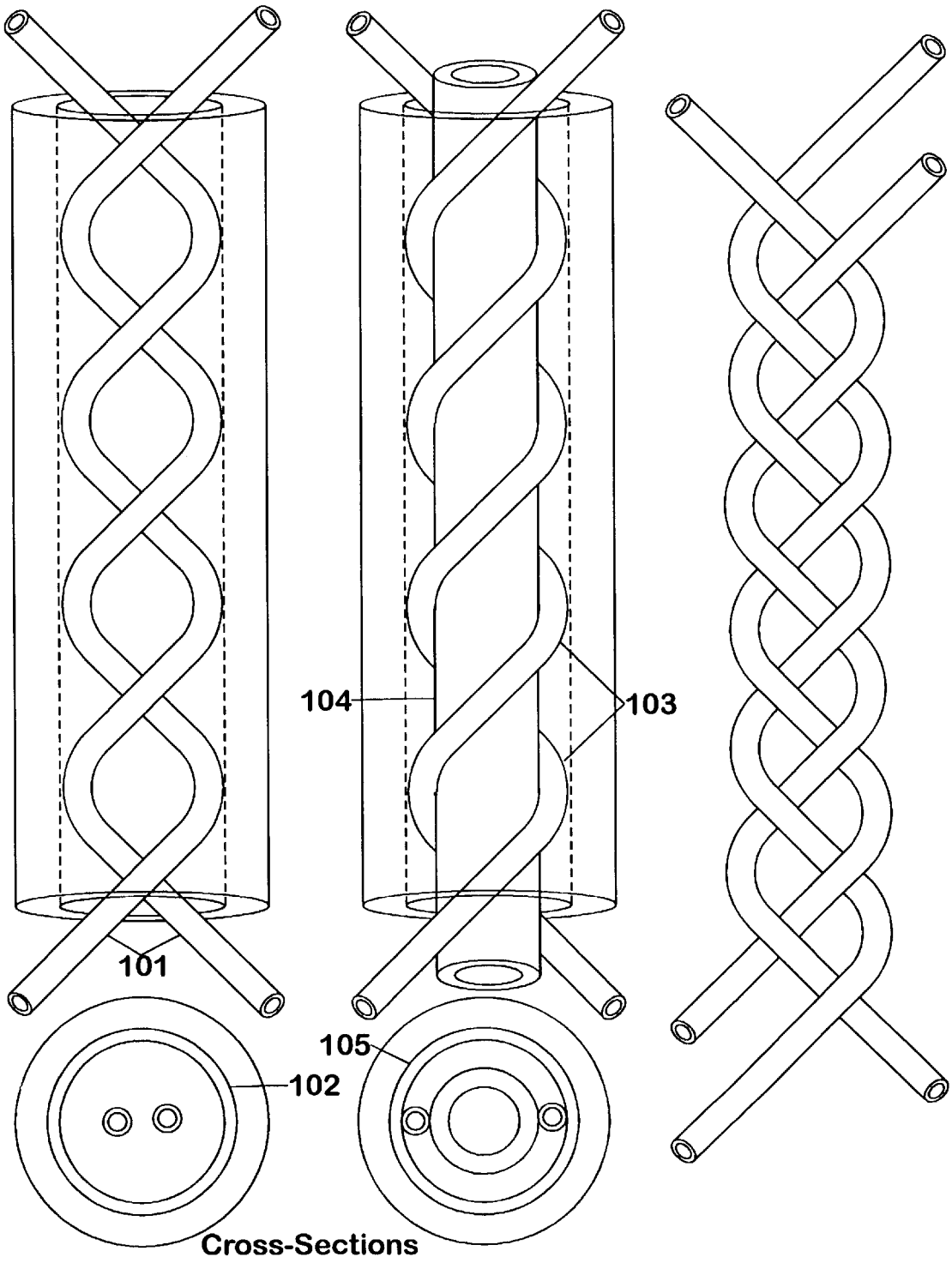
FIG. 1 illustrates the geometry of three prior art types of balanced interconnects.

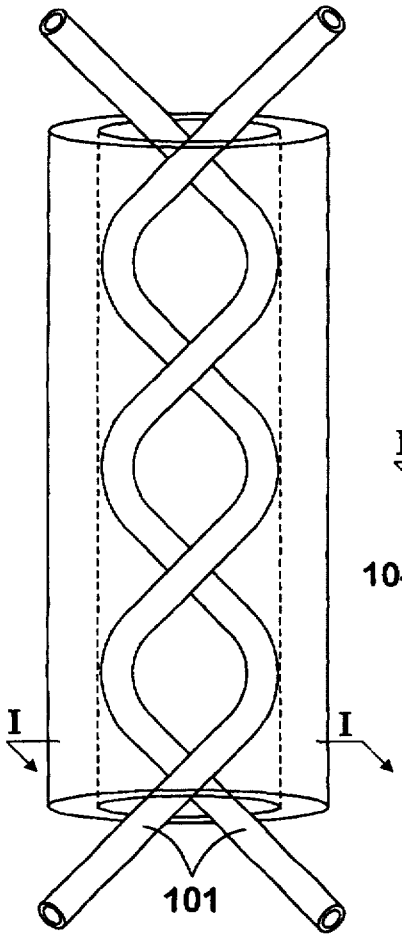
Fig. 1a
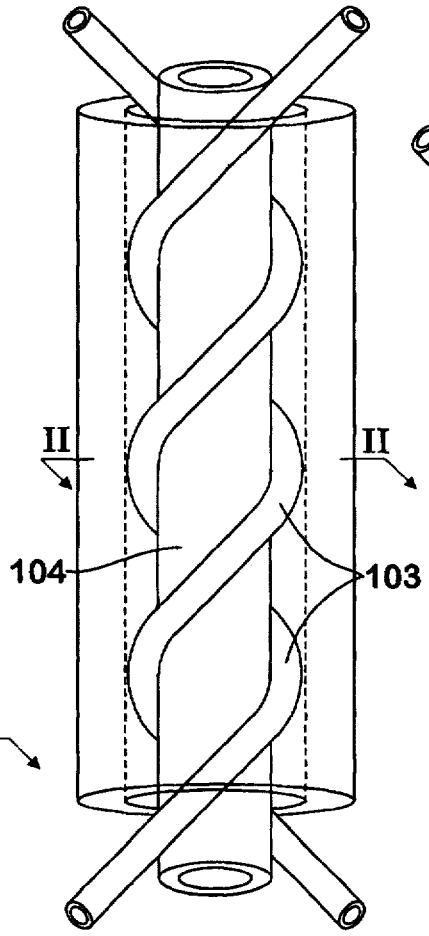
Fig. 1b
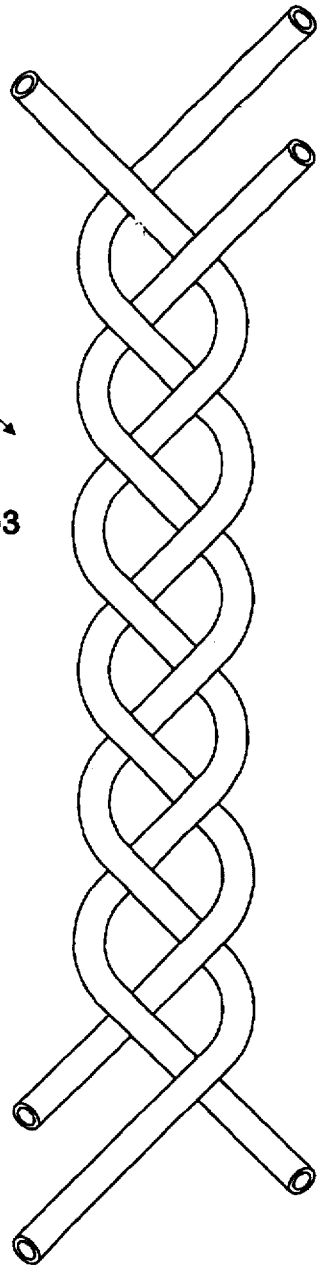
Fig. 1c
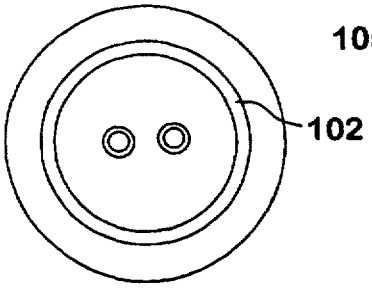
(Section I-I)
Prior Art
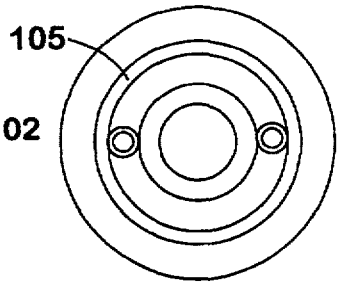
(Section II-II)
Prior Art
Prior Art